US007294310B2

(12) United States Patent
Yamazaki et al.

(10) Patent No.: US 7,294,310 B2
(45) Date of Patent: Nov. 13, 2007

(54) LIQUID TRANSPORT DEVICE AND LIQUID TRANSPORTING METHOD

(75) Inventors: Takeo Yamazaki, Kanagawa (JP); Takeshi Imamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 98 days.

(21) Appl. No.: 10/480,040

(22) PCT Filed: Aug. 5, 2003

(86) PCT No.: PCT/JP03/09909

§ 371 (c)(1),
(2), (4) Date: Jul. 28, 2004

(87) PCT Pub. No.: WO2004/012863

PCT Pub. Date: Feb. 12, 2004

(65) Prior Publication Data

US 2004/0258569 A1 Dec. 23, 2004

(30) Foreign Application Priority Data

Aug. 6, 2002 (JP) ..... 2002-229245

(51) Int. Cl.
*B01L 3/02* (2006.01)

(52) U.S. Cl. ..... 422/100; 422/63

(58) Field of Classification Search ..... 422/101, 422/70, 100, 63, 102, 104; 436/161, 180; 250/288; 204/453, 604, 601; 347/40, 77–78, 347/87; 141/194
See application file for complete search history.

(56) References Cited

U.S. PATENT DOCUMENTS

| | | | | |
|---|---|---|---|---|
| 4,607,163 | A * | 8/1986 | Mizuno | 250/288 |
| 5,872,010 | A * | 2/1999 | Karger et al. | 436/173 |
| 5,917,184 | A * | 6/1999 | Carson et al. | 250/288 |
| 6,103,199 | A | 8/2000 | Bjornson et al. | 422/100 |
| 6,192,768 | B1 | 2/2001 | Wallman et al. | 73/864.83 |
| 6,476,215 | B1 | 11/2002 | Okamoto et al. | 536/25.3 |
| 6,555,389 | B1 * | 4/2003 | Ullman et al. | 436/514 |
| 2002/0146715 | A1 | 10/2002 | Okamoto et al. | 435/6 |
| 2002/0197733 | A1 | 12/2002 | Bohm et al. | 436/180 |
| 2003/0059817 | A1 | 3/2003 | Okamoto et al. | 435/6 |

FOREIGN PATENT DOCUMENTS

| | | |
|---|---|---|
| EP | 0 672 834 A1 | 9/1995 |
| JP | 10-337173 | 12/1998 |
| JP | 11-187900 | 7/1999 |
| JP | 2001-212469 | 8/2001 |
| JP | 2002-181839 | 6/2002 |
| JP | 2003-121452 | 4/2003 |

* cited by examiner

*Primary Examiner*—Jill Warden
*Assistant Examiner*—Natalia Levkovich
(74) *Attorney, Agent, or Firm*—Fitzpatrick, Cella, Harper & Scinto

(57) ABSTRACT

A liquid transport device capable of introducing and transporting a liquid and preventing a backward flow of the liquid in a small-sized analysis system is provided. The liquid transport device has a substrate 201, an ejection orifice 205, which is formed integrally with the substrate 201 and through which a liquid is ejected, a space portion 210, which is formed so as to communicate with the ejection orifice 205 and through which the liquid ejected from the ejection orifice flies, and a flow channel 204, which communicates with the space portion 210 and which is positioned within such a distance range that the flying liquid can reach the flow channel.

8 Claims, 7 Drawing Sheets

LIQUID TRANSPORT DEVICE AND LIQUID TRANSPORTING METHOD

TECHNICAL FIELD

The present invention relates to a liquid transport device and a liquid-transporting method for transporting a liquid in a small-sized analysis system (μTAS: Micro Total Analysis System) in which chemical analysis or chemical synthesis is performed on a chip, for example.

BACKGROUND ART

With the development of a three-dimensional fine processing technique in recent years, attracting attention are systems that comprise fluid elements, such as a fine flow channel, a pump, and a valve, and a sensor integrated on a substrate, such as glass or silicon, to conduct chemical analysis on the substrate. Such a system is called a miniaturized analysis system, a μ-TAS (Micro Total Analysis System), or a Lab on a Chip. The miniaturization of a chemical analysis system enables a decrease of noneffective space volume and a remarkable decrease in the sample size, as well as a reduction of the analysis time and a decrease in power consumption of the entire system. Further, the miniaturization promises to lower the price of the system. Furthermore, the μ-TAS is a promising system for use in medical services, such as home medical care and bed-side monitoring, and biological techniques, such as DNA analysis and proteomic analysis.

Japanese Patent Application Laid-Open No. 10-337173 discloses a microreactor, which is suitable for conducting a sequence of biochemical experimental steps comprising mixing and reacting solutions, determination and analysis, and separation, by utilizing a combination of several cells. FIG. 6 illustrates schematically a concept of microreactor 601. Microreactor 601 has an isolated reaction chamber sealed with a flat plate on a silicon substrate. This microreactor has reservoir cell 602, mixing cell 603, reaction cell 604, detection cell 605, and separation cell 606 in combination. By providing more than one such a reactor on a substrate, many biochemical reactions can be allowed to proceed simultaneously and in parallel. Not only the analysis, but material synthesis, such as protein synthesis, can be conducted in a reactor.

In Jr-Hung Tsai and Liwei Lin, "A Thermal Bubble Actuated Micro Ejection orifice-Diffuser Pump", Proceedings of 2001 IEEE Micro Electromechanical Systems Workshop, 2001, pp. 409 to 412, a device is disclosed in which a liquid is heated by a heater to form a bubble, so that the liquid is transported by using the expansion and shrinkage of the bubble. FIGS. 7A and 7B show the principle of this device. In this device, a heat generating element 703 is formed in a chamber 702. Tapered flow channels 706 and 705 are formed at an inlet 707 and an outlet 704 communicating with the chamber 702. A bubble 701 is generated in the chamber by applying a voltage to the heat generating element 703. The generated bubble expands for a certain time period, then shrinks, and disappears.

At the time of expansion of the bubble 701, a liquid in the chamber 702 flows out of the chamber by a force applied to the liquid by the expansion of the bubble. A difference in flow channel resistance occurs between the inlet 707 and the outlet 704 due to the tapered shapes of the flow channels 706 and 705. Therefore, the flow rate at which the liquid flows out through the outlet 704 is higher than that at which the liquid flows out through the inlet 707 (FIG. 7A).

At the time of shrinkage of the bubble 701, the liquids at the outlet and inlet sides flow into the chamber. In this case, the flow rate at which the liquid flows in through the inlet 707 is higher than that at which the liquid flows in through the outlet 704 (FIG. 7B), in contrast with the expansion case.

The heat generating element 703 is repeatedly driven to cause the bubble 701 to repeat expanding and shrinking. The liquid is thereby transported from the inlet 707 side to the outlet 704 side (the direction from right to left as viewed in FIGS. 7A and 7B).

Conventionally, in a case where a microreactor, such as the one disclosed in Japanese Patent Application Laid-Open No. 10-337173 and shown in FIG. 6, is used, a silicone tube, for example, is connected to the reservoir cell 602 and a liquid sample is introduced into the reactor by using a syringe pump or the like. In such a case, the syringe pump is required outside the microreactor, disadvantageously increasing the cost and the size of the entire system. In a case where a liquid sample is applied dropwise in the reservoir by using a dispenser or the like, a considerably large device is also required outside the microreactor.

Also, in a microreactor such as that shown in FIG. 6, it is possible that a liquid mixed in the mixing cell 603 or a liquid caused to react in the reaction cell 604 will flow backward to the reservoir cell 602, and a stable chemical reaction will not be performed. As a method of preventing such a backward flow, it is possible to form a microvalve in the microreactor. However, a considerably large number of steps are required to form a microvalve, resulting in an undesirable increase in the manufacturing cost. Moreover, since the valve is opened and closed a larger number of times, the opening/closing performance and sealing characteristics of the valve deteriorate with time and the useful life of the microreactor is reduced.

In the liquid transport device shown in FIGS. 7A and 7B, outlet 704 and inlet 707 are in liquid communication, and it is possible that the liquid at the outlet 704 side can flow backward toward the inlet 707 side. In particular, when the heat generating element is not driven, a diffusion occurs due to the liquid communication between outlet 704 and inlet 707, resulting in a mixing of the liquid at the outlet 704 side and the liquid at the inlet 707 side. In order to prevent this, there is also a need to form a microvalve.

DISCLOSURE OF THE INVENTION

An object of the present invention is to provide a liquid transport device, which is capable of introducing and transporting a liquid without using, outside the device, a mechanism, such as a syringe pump or a dispenser, for introducing the liquid, and which reduce the size and the cost, and a liquid-transporting method having such advantages.

Another object of the present invention is to provide a liquid transport device and a liquid-transporting method capable of preventing a backward flow of a liquid without using a microvalve having a complicated mechanism.

Still another object of the present invention is to provide a long-life chemical analysis apparatus and a chemical analysis method capable of performing a chemical reaction with stability by using the above-described liquid transport device.

That is, the present invention provides a liquid transport device comprising:

a substrate;

a liquid transport portion provided integrally with the substrate and having an ejection orifice and an ejection means for ejecting a liquid;

a space portion communicating with the ejection orifice, the liquid ejected from the ejection orifice flying through the space portion; and a flow channel communicating with the space portion, positioned within such a distance range that the flying liquid can reach the flow channel from the ejection orifice and having a receiving port for receiving the flying liquid, wherein the liquid is ejected from the ejection orifice, causing it to fly through the space portion and transported in the flow channel through the receiving port.

The present invention also provides a liquid-transporting method comprising the steps of:

causing a liquid to fly through a space portion by ejecting the liquid; and transporting the liquid in a predetermined direction by bringing the liquid having flown through the space portion into contact with another other liquid.

The present invention makes it possible to transport a liquid without externally supplying pressure by using a pump or the like. Also, the liquid in the ejection orifice and the liquid in the flow channel of the present invention are separated from each other by a gas in the space portion, so that the present invention makes it possible to prevent a backward flow of the liquid without a complicated mechanisms, such as a microvalve.

These constitutions make it possible to provide a long-life chemical analysis apparatus capable of performing a chemical reaction with stability at a reduced cost.

BEST MODE FOR CARRYING OUT THE INVENTION

The present invention will be described below in detail.

Figure 2A:
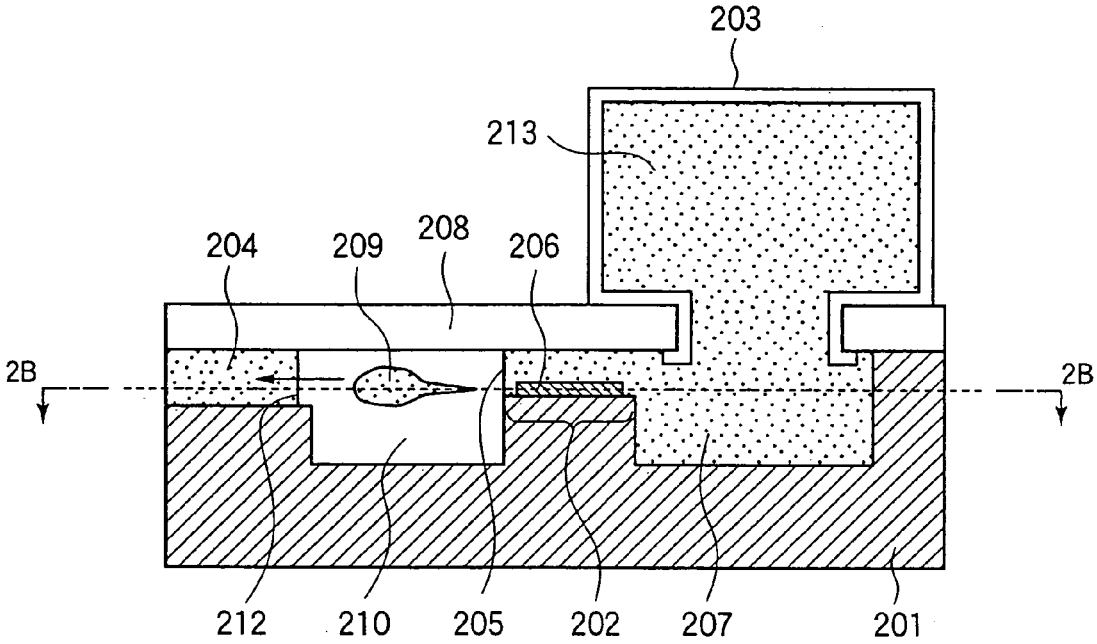
FIGS. 2A and 2B are diagrams schematically showing the liquid transport device of the present invention.
Figure 2B:
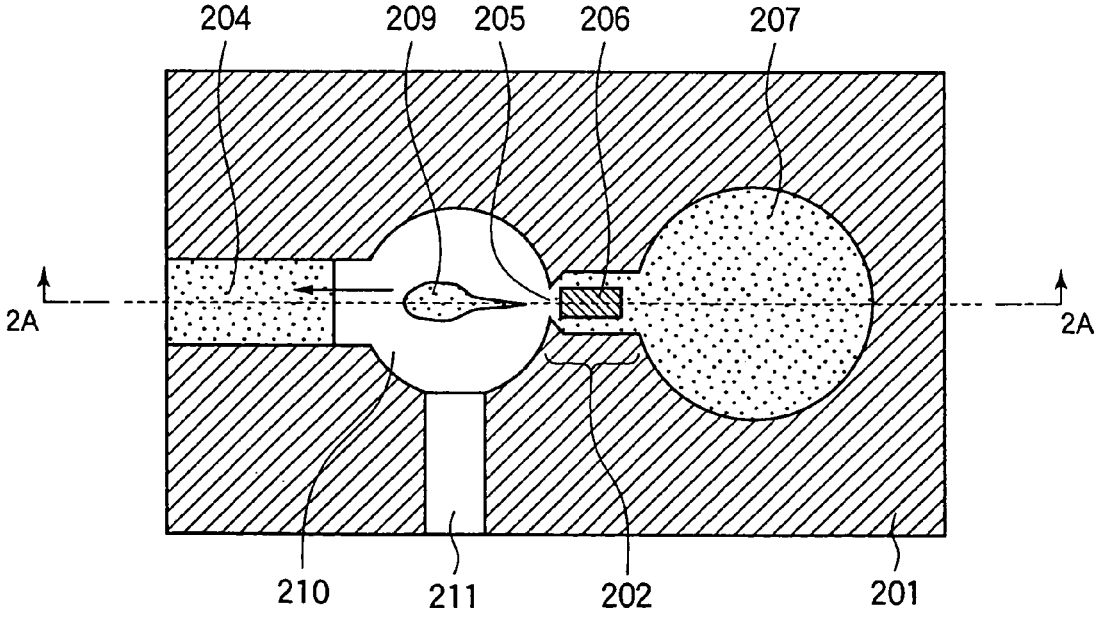

One embodiment of a liquid transport device of the present invention shown in FIGS. 2A and 2B has a liquid transport portion 202 having integratedly an ejection orifice 205 and a heat generating element 206 provided as the ejection means, a space portion 210 for flying of a droplet 209 ejected through the ejection orifice 205, and a flow channel 204 communicating with the space portion 210. The liquid transport device in this embodiment further has a supply chamber 207 for supplying a liquid to the liquid transport portion 202.

The flow channel 204 has a receiving port 212 positioned at a distance through which the droplet 209 ejected from the ejection orifice 205 can fly to reach the receiving port 212 to receive the droplet 209. The liquid in the liquid transport portion 202 and the liquid in the flow channel 204 are separated from each other by a gas in the space portion. The liquid in the flow channel is thereby prevented from flowing backward to contact the liquid in the liquid transport portion. Therefore, there is no need to provide a complicated mechanism, such as a microvalve, for preventing a backward flow.

The liquid transport device shown in FIGS. 2A and 2B is also provided with a liquid supply tank 203 above the supply chamber 207 for the purpose of supplying the liquid to the supply chamber 207. The liquid supply tank 203 is detachably attached to the liquid transport device and is interchangeable. The liquid supply tank 203 may be filled with a porous material, such as a sponge. The liquid in the liquid transport portion 202 is therefore prevented from leaking out to the space portion 210 by a negative pressure caused in the liquid transport portion by this constitution of the liquid supply tank 203. A surface treatment, such as a water repellency treatment or a hydroohilic treatment, according to the kind of the liquid on the inner wall surface of the space portion 210 is an example of a method that can be used to inhibit the liquid from leaking out to the space portion.

The upper surfaces of the flow channel 204, the space portion and the liquid transport portion 202 are formed with an intercepting member 208. If the intercepting member is formed of a material which does not allow outside air to pass through it, the liquids in the flow channel and the liquid transport portion are intercepted from outside air. Transport of a liquid which may be denatured when brought into contact with atmosphere is thereby enabled without denaturing. If a material capable of transmitting light is used for the intercepting member, the state of transport can be checked from the outside. On the other hand, the intercepting member may be formed of a material not transmitting light for the purpose of preventing denaturing of the transported liquid by light.

Figure 3:
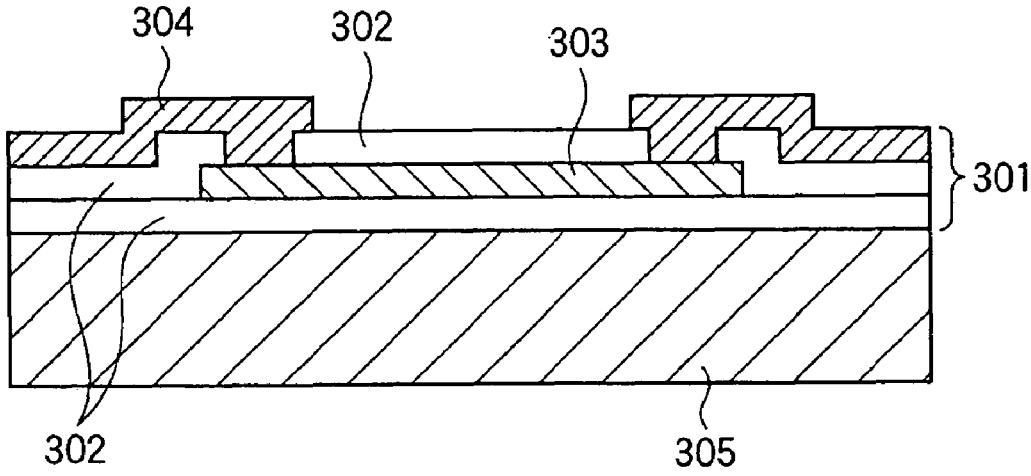
FIG. 3 is a diagram schematically showing a heat generating element used in the liquid transport device of the present invention.

The heat generating element 206 for generating a bubble in the liquid is provided in the liquid transport portion 202. FIG. 3 shows an example of the construction of the heat generating element. A heat generating element 301 is comprised of a thin-film resistor 303, electrodes 304 and protective layers 302 and is formed on a substrate 305. The thin-film resistor 303 is sandwiched between the protective layers 302, which is an insulating material, on upper and lower surfaces thereof. Opposite end portions of the thin-film resistor 303 are electrically connected to the electrodes 304 via contact holes formed in the protective layer 302. A voltage is applied across the thin-film resistor through the electrodes 304 to heat the heat generating element. The material of the thin-film resistor 303 is, for example, a metallic material or a semiconductor material such as silicon having electrical conductivity. Protection of the surface of the thin-film resistor 303 from chemical reaction can be achieved by the protective layer 302. Preferably, the material of the protective layer 302 is one having high tolerance against chemicals. For example, the material of the protective layer 302 is an insulating material such as $SiO_2$ or $Si_3N_4$, or a metallic material such as Ta.

A well-known piezoelectric material or an electrostatic actuator employed in ink jet heads or the like, other than the heat generating element, may be used as the ejection means.

The method of transporting a liquid by using the liquid transport device shown in FIGS. 2A and 2B will next be described in detail.

A liquid supplied to the supply chamber 207 from liquid supply tank 203 is first fed to liquid transport portion 202 having heat generating element 206. Heat generating element 206 has a thin-film resistor and an electrode (not shown) for applying a pulse voltage to the thin-film resistor. A pulse voltage is applied to the thin-film resistor in a state where the liquid exists on the thin-film resistor to abruptly increase the temperature to a point at which film boiling occurs, thereby generating a bubble. The generated bubble expands abruptly. By a working force according to the abrupt expansion of the bubble, the sample liquid is forced out of ejection orifice 205 to form an ejected droplet 209. The ejected droplet 209 flies through space portion 210, reaches flow channel 204, and contacts the liquid in the liquid channel 204. The liquid in liquid channel 204 is thereby transported in a predetermined direction. The bubble after expansion starts shrinking and disappears with a lapse of time, followed by soaking up to the next amount of the liquid from the supply chamber to fill the liquid transport portion. The time from generation to collapse of the bubble is several μsec to about 20 μsec. Accordingly, expansion and shrinkage of the bubble can be repeated at a frequency of about ten and several kHz at the maximum to eject the sample liquid. The liquid transported to flow channel 204 is fed to a subsequent flow channel, a mixing chamber for mixing with a plurality of liquids, etc.

While a case of transporting a liquid to a subsequent flow channel, a mixing chamber or the like through the flow channel 204 has been described, embodiments are also possible in which a liquid is directly transported from liquid transport portion 202 to a flow channel, mixing chamber or the like without being fed through flow channel 204.

There is a possibility of a different kind of sample liquid or a sample denatured by contact with atmosphere being mixed as a contaminant in supply chamber 207 and consequently mixed as a contaminant in the flow channel 204, for example when the liquid supply tank is changed. In order to prevent the contamination of the flow channel, the distance through which ejected droplet 209 can fly may be reduced by changing heat generating element 206 drive conditions to cause the ejected droplet 209 to fall to the bottom portion or side wall portion of space portion 210 without reaching the receiving port 212.

In some cases, for example, the change of a liquid tank, a need arises to discharge an old liquid sample existing in liquid transport portion 202, flow channel 204 and supply chamber 207. In such cases, the old liquid is discharged through channel 211 by a suction of a pump or it moves away with the flow of a cleaning liquid in the direction from the supply chamber 207 to the flow channel 204. The discharging operation in the device of the present invention may be before or after the change of the liquid tank.

Figure 1:
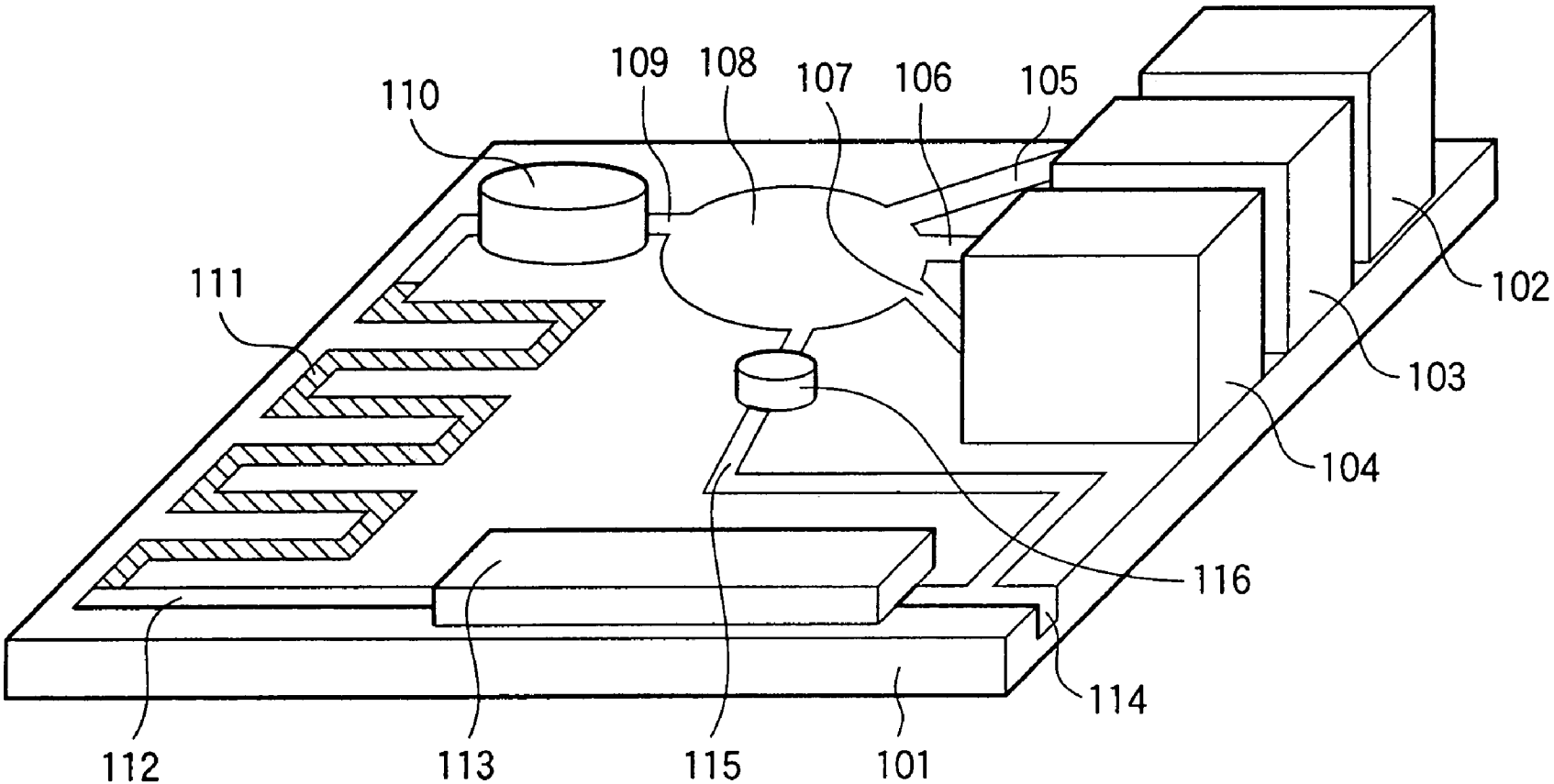
FIG. 1 is a diagram schematically showing a chemical analysis apparatus using a liquid transport device of the present invention.

FIG. 1 is a diagram schematically showing a form in which a chemical analysis apparatus using the liquid transport device of the present invention is provided. Separation and detection of each component of a liquid sample performed by using the chemical analysis apparatus shown in FIG. 1 will be described as an example.

The chemical analysis apparatus shown in FIG. 1 is comprised of liquid supply tanks 102 to 104, liquid transport devices of the present invention which are not directly shown in the FIG. but are positioned below the respective liquid supply tanks, and a chemical analysis portion from flow channels 105 to 107 to a discharge port 114. An intercepting member forming the upper surface of the chemical analysis portion, which member may also form the upper surface of the liquid transport devices, is not shown in the figure. Liquids are introduced into the chemical analysis portion from the liquid supply tanks by the liquid transport devices. The liquids supplied to the flow channels 105 to 107 by the liquid transport devices are introduced into a mixing chamber 108 and mixed with each other in the mixing chamber 108. A liquid obtained by the mixing is fed to a separation section 111 through a liquid channel 109 by a known conventional pump 110 formed on a substrate 101 and is separated into components in the separation section 111. A liquid chromatography method and an electrophoresis method can exemplify a method of the separation. The separated components are introduced into a detection section 113 through a flow channel 112 where the components are detected. An electrochemical detection method or a detection method using fluorescence can exemplify a method for the detection. The sample on which detection has been performed is discharged out of the apparatus through the discharge port 114.

The liquid supply tanks 102 to 104 can be detachably attached to the liquid transport devices as described above, that is, to the chemical analysis apparatus. A necessary step can therefore be performed easily by changing some of the tanks in a case where a liquid sample in a tank is used up or in a case where a different liquid sample is introduced into the analysis apparatus. Since the liquid in each tank is introduced from the tank into the chemical analysis apparatus by the mechanism in the liquid transport device of the present invention, there is no need to provide a pump, a dispenser or the like outside the chemical analysis apparatus.

It is possible that immediately after the change of the liquid tanks old liquid samples or different kinds of liquid samples remain in the mixing chamber, so that a need may arise to discharge the liquid in the mixing chamber to the outside. In such a situation, a valve 116, which is closed during normal operation for the analysis, may be opened to feed the liquid in the mixing chamber to the discharge portion 114 through the flow channel 115 and to discharge the liquid to the outside. In this arrangement, it is preferable to reduce the flow channel resistance by increasing the section of a flow channel 115 along a direction perpendicular to the liquid flow direction relative to that of the flow channel 109. Rapid discharge of the unnecessary liquid in the mixing chamber can be made possible in this manner.

EXAMPLES

The present invention will now be described in more detail with reference to the following Examples.

The size, configuration, materials, manufacturing conditions, reacting conditions, etc., described below are only examples and these factors may be freely changed as design items if they are in such ranges as to satisfy the requirements of the present invention.

Example 1

A method of manufacturing the liquid transport device of the present invention will be described as this example, using the step diagrams of FIGS. 4A to 4D.

Figure 4A:
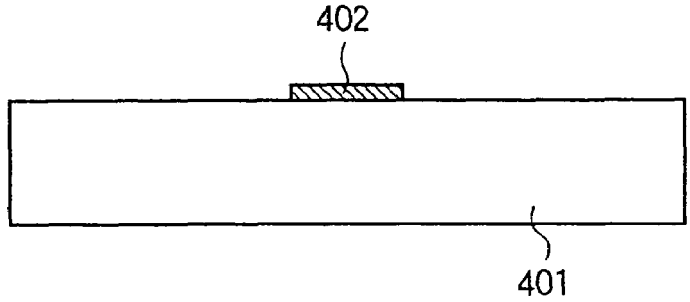
FIGS. 4A, 4B, 4C and 4D are diagrams schematically showing a process for manufacturing the liquid transport device of the present invention.

A heat generating element 402 comprised of a thin-film resistor and electrodes (not shown) for applying a pulse voltage to the thin-film resistor was formed on a silicon substrate (20 mm in a longitudinal direction, 20 mm in a width direction) 401. The construction of the heat generating element in this example is the same as that shown in FIG. 3. The material of the thin-film resistor is polycrystalline silicon made electrically conductive by introducing P (phosphorous) ions. The surface of the thin-film resistor is covered with a SiN film (not shown), which is a protective layer (FIG. 4A).

Figure 4B:
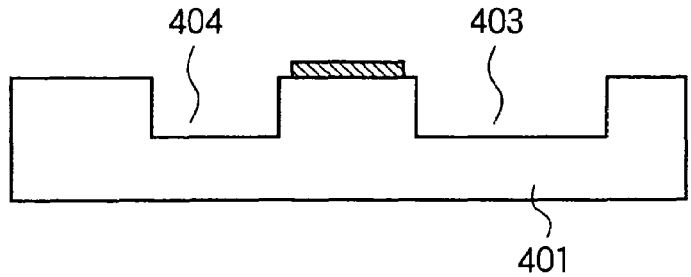

A photoresist pattern was next formed by a photolithography method. Dry etching was performed by using $SF_6$ gas and $C_4F_8$ gas, with the photoresist pattern used as an etching mask to form a supply chamber 403 and a space portion 404 (FIG. 4B). In this step, the heat generating element 402 is protected by the photoresist.

Figure 4C:
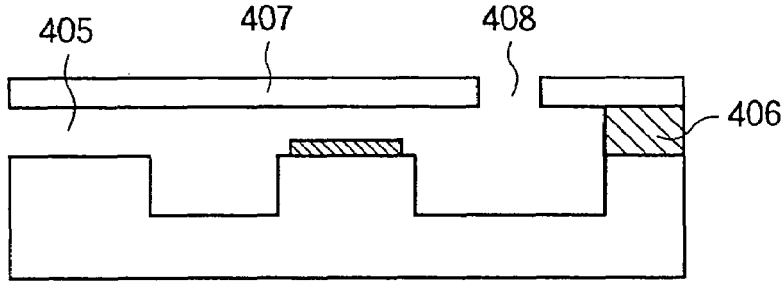

A silicon substrate 406 formed by photolithography and dry etching so as to form a flow channel 405, an upper portion of the space portion 404, a fluid transport portion and an upper portion of the supply chamber 403 was adhered to the silicon substrate 401 by using an epoxy adhesive. Further, an intercepting member 407 made of glass was adhered to the silicon substrate 406 by using an epoxy adhesive. A liquid supply opening 408 for supplying a liquid from a liquid supply tank to the supply chamber 403 was formed by etching in advance (FIG. 4C).

The liquid transport device schematically shown in FIGS. 2A and 2B was made by the above-described process.

Figure 4D:
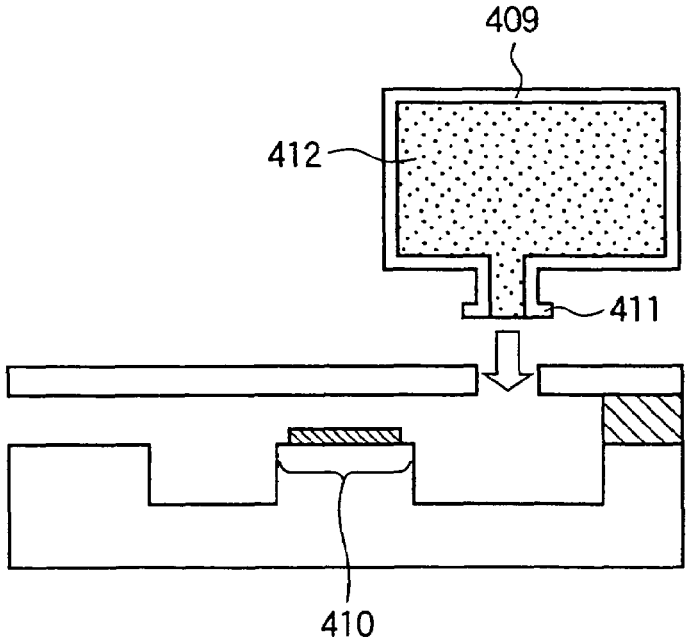

The liquid supply tank 409 made of polypropylene was made. The liquid supply tank 409 has a snap collar portion 411 and can be fixed in such a manner that the snap collar portion 411 is caught in the liquid supply opening 408. The liquid supply tank 409 in a state of being filled with a liquid was fitted to the liquid supply opening 408 (FIG. 4D). By this step, the supply chamber 403 and the liquid transport portion 410 were filled with the liquid.

Example 2

Figure 5:
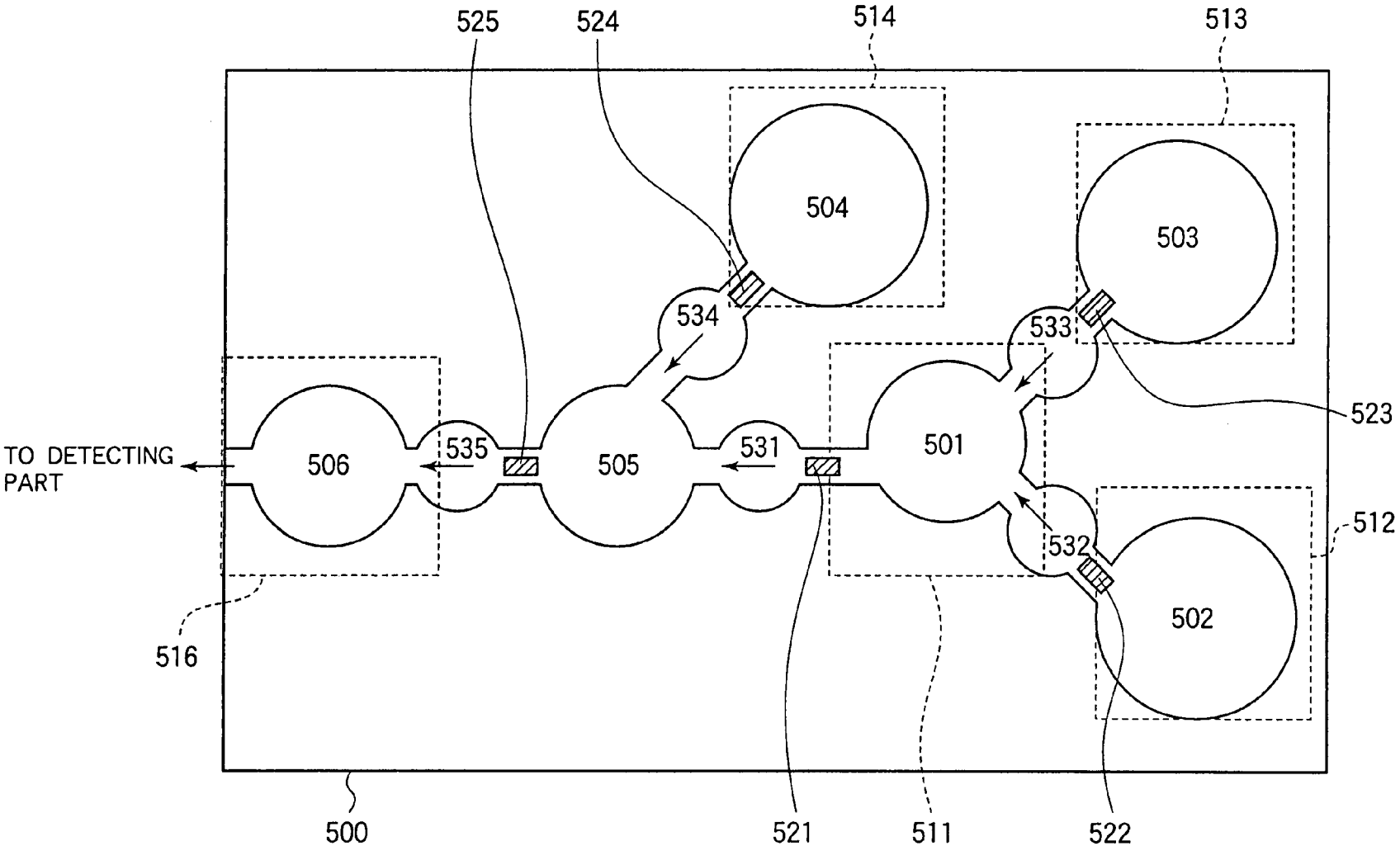
FIG. 5 is a diagram schematically showing a chemical analysis apparatus using the liquid transport device of the present invention.
Figure 6:
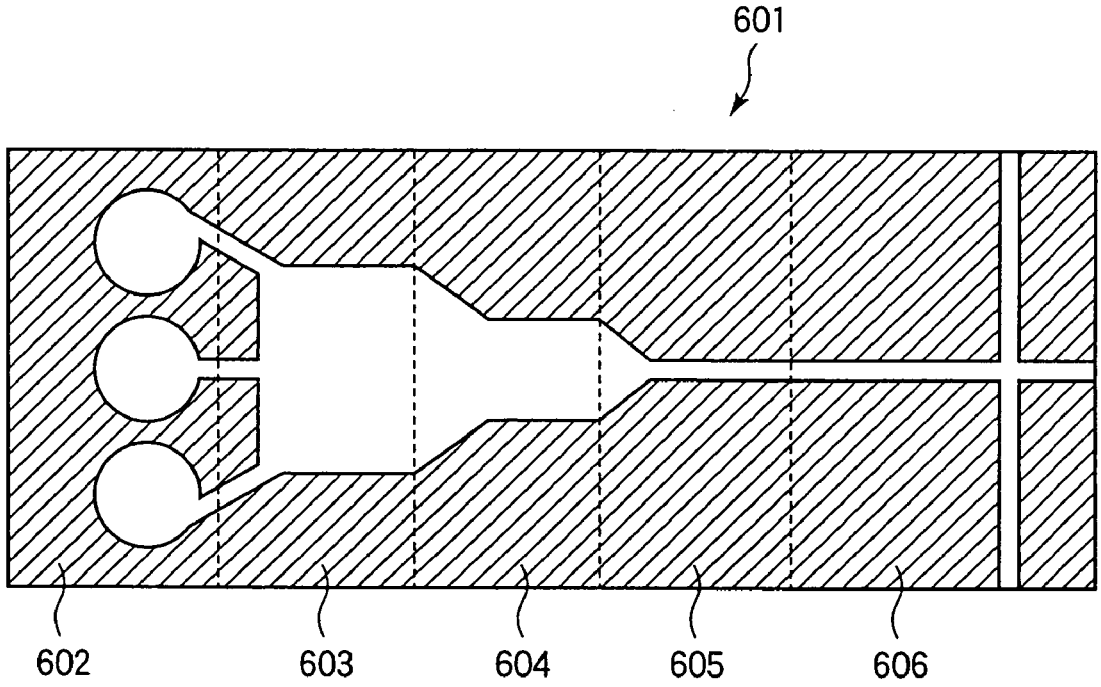
FIG. 6 is a diagram schematically showing a conventional microreactor.
Figure 7A:
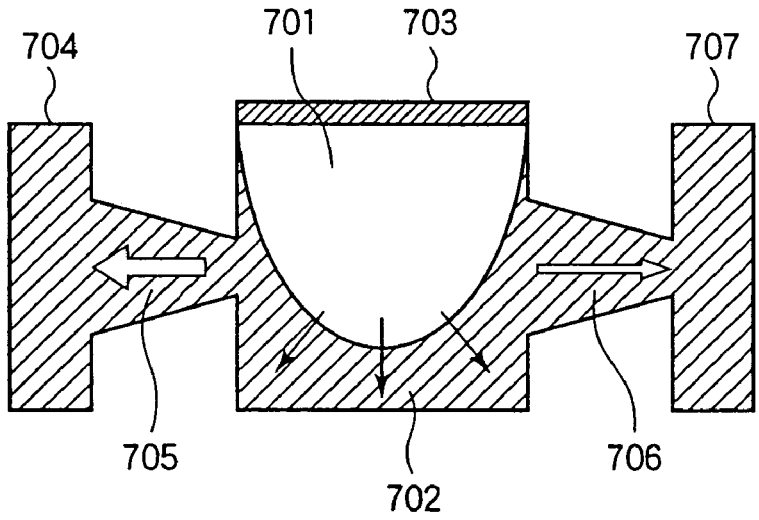
FIGS. 7A and 7B are diagrams schematically showing a conventional liquid transport device.
Figure 7B:
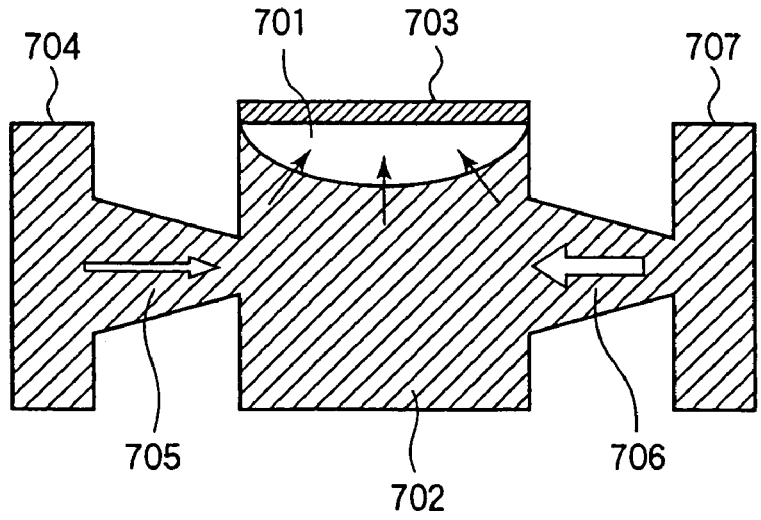

A chemical analysis apparatus formed by combining liquid transport devices each corresponding to that shown in FIGS. 2A and 2B was made. FIG. 5 is a cross-sectional view of this apparatus, corresponding to the 2B-2B section of FIG. 2A. The chemical analysis apparatus in this example can be made by a manufacturing method, which is the same as that in Example 1, except that the photomask used in photolithography is changed.

In the chemical analysis apparatus of this example, supply chambers 502 to 504 and 506 and mixing chamber 501 and 505 are formed on a substrate (25 mm in a longitudinal direction, 40 mm in a width direction). The mixing chamber 501 also functions as a supply chamber. The supply chamber 506 also functions as a mixing chamber. Liquid supply tanks 511 to 514 and 516 are provided at mixing chamber 501 and supply chambers 502 to 504 and 506. In FIG. 5, each liquid supply tank is indicated by the dotted line. In liquid transport portions following mixing chambers 501 and 505 and supply chambers 502 to 504, heat generating elements 521, 525 and 522 to 524 for transporting liquids to the mixing chamber on the downstream side are provided. Space portions 531 to 535 are provided subsequently to their respective liquid transport portions. These space portions are provided for a separation between the supply chambers and the mixing chambers and between the mixing chambers. Therefore, the liquids in the chambers are not mixed with each other. In FIG. 5, the direction in which a droplet flies in each space portion is indicated by the arrow.

A measurement of carnitine palmitoyltransferase in a rat's liver was performed by using the chemical analysis apparatus shown in FIG. 5. The process of the measurement is as described below.

First, water is added to and sufficiently mixed with a buffer solution (16 mM Tris-HCl buffer solution, 2.5 mM EDTA, 0.2% Triton X-100 (a trade name of a product from KISHIDA CHEMICAL CO., LTD.) pH 8.0, 0.5 ml). The resulting solution is put in liquid supply tank 511. The liquid supply tank 511 is placed on the mixing chamber 501 to introduce the solution into the mixing chamber 501. "M" represents a unit of concentration in terms of "mol/l".

Next, part of the liver of a rat (about 30 g) washed with cold physiological saline is homogenized with 200 ml of a homogenizing buffer solution (3 ml Tris-HCl (pH 7.2) containing 0.25 M saccharose liquid and 1 mM EDTA) and subjected to centrifugation at 500×g for 10 minutes (4° C.). A supernatant liquid thereby obtained is transferred into a different centrifugal tube to be subjected to centrifugation at 9,000×g for 10 minutes (4° C.), thereby obtaining a specimen sample as a supernatant liquid. The obtained specimen sample solution is put in the liquid supply tank 512 and liquid supply tank 512 is placed on supply chamber 502, thereby introducing the specimen sample solution into supply chamber 502.

Similarly, a 5 mM DTNB aqueous solution is introduced into supply chamber 503 through liquid supply tank 513.

Similarly, an 80 μM Palmitoyl-CoA solution (a name of a product from SIGMA CHEMICAL CO.) is introduced into supply chamber 504.

Similarly, a solution prepared by adding water to a buffer solution (16 mM Tris-HCl buffer solution, 2.5 mM EDTA, 0.2% Triton X-100 (pH 8.0); 0.5 ml) is introduced into supply chamber 506.

In this state, heat generating element 522 is driven to transport the liquid in supply chamber 502 to mixing chamber 501. Simultaneously, heat generating element 523 is driven to transport the liquid in supply chamber 503 to mixing chamber 501. The state in which the two liquids exist in mixing chamber 501 is maintained for one minute.

Next, heat generating element 521 is driven to transport the liquid in mixing chamber 501 to mixing chamber 505. Simultaneously, heat generating element 524 is driven to transport the liquid in supply chamber 504 to mixing chamber 505. The state in which the two liquids exist in mixing chamber 505 is maintained for one minute.

Subsequently, heat generating element 525 is driven to transport the liquid in mixing chamber 505 to supply chamber 506. This liquid is mixed with the liquid from the liquid supply tank 516. Thereafter, the liquid in supply chamber 506 is transported to the detecting part to measure the absorption of light at a wavelength of 500 nm. In this manner, changes with the course of time in activity of carnitine palmitoyltransferase in the liver of a rat were measured.

The invention claimed is:

1. A liquid transport device comprising:

a substrate;

a liquid transport portion integrally provided with said substrate and having an ejection orifice and ejection means for ejecting a liquid;

a space portion communicating with said ejection orifice, the liquid ejected from the ejection orifice flying through the space portion; and a flow channel communicating with the space portion, capable of receiving the liquid flying from the ejection orifice, and having a receiving port for receiving the flying liquid, wherein the liquid is ejected from the ejection orifice, thereby caused to fly through the space portion and transported in the flow channel through the receiving port, and the space portion and the flow channel were integrally provided with the substrate, and the space portion contains a recessed portion formed in the substrate and a bottom surface of the recessed portion is located at a lower position than that of the ejection orifice.

2. The liquid transport device according to claim 1, wherein the liquid in the ejection orifice and the liquid in the flow channel are separated from each other by a gas in the space portion.

3. The liquid transport device according to claim 1, which further comprises a supply chamber for supplying the liquid to the ejection means.

4. The liquid transport device according to claim 1, comprising a plurality of flow channels and a mixing chamber in communication with the flow channels for mixing a plurality of liquids transported through the flow channels, the mixing chamber provided on the downstream side of the flow channels.

5. The liquid transport device according to claim 4, which further comprises an analysis means for analyzing a particular component contained in the liquid after mixing in the mixing chambers, the analysis means being provided on the downstream side of the mixing chambers.

6. The liquid transport device according to claim 5, wherein the analysis means is comprised of:

a separation means for separating the liquid into a plurality of components; and a detection means for detecting the kinds of the components.

7. The liquid transport device according to claim 1, which further comprises a second flow channel for discharging the liquid accumulated in the space portion to the outside of the substrate.

8. The liquid transport device according to claim 1, wherein the ejection means ejects the liquid through the ejection orifice by applying energy to the liquid.

* * * * *